United States Patent [19]

Tojo et al.

[11] 4,084,623

[45] Apr. 18, 1978

[54] FLUID JET LOOM WITH A YARN WASTE REMOVING APPARATUS

[75] Inventors: Akio Tojo, Higashi-murayama; Kimimasa Ohnishi, Tokyo, both of Japan

[73] Assignee: Nissan Motor Company, Limited, Japan

[21] Appl. No.: 741,956

[22] Filed: Nov. 15, 1976

[30] Foreign Application Priority Data

Jun. 17, 1976 Japan ..... 51-70369

[51] Int. Cl.[2] ..... D03D 47/30

[52] U.S. Cl. ..... 139/435; 139/1 C; 226/97

[58] Field of Search ..... 139/1 C, 435, 450, 452; 226/97, 195

[56] References Cited

U.S. PATENT DOCUMENTS

| | | | |
|---|---|---|---|
| 3,161,209 | 12/1964 | Scheffel | 139/435 |
| 3,376,901 | 4/1968 | Strake | 139/435 |

*Primary Examiner*—Henry S. Jaudon

*Attorney, Agent, or Firm*—Robert E. Burns; Emmanuel J. Lobato; Bruce L. Adams

[57] ABSTRACT

A casing is disposed about yarn grasping means, in which yarn waste is collectable, to allow the yarn waste in the casing to be enforcedly exhausted therefrom by the suctorial operation mode by a weft yarn shooting nozzle.

13 Claims, 4 Drawing Figures

FLUID JET LOOM WITH A YARN WASTE REMOVING APPARATUS

BACKGROUND OF THE INVENTION

The present invention relates in general to a fluid jet loom and more particularly to a yarn waste removing apparatus employed in the fluid jet loom. More specifically, the present invention is concerned with such removing apparatus which is particularly used for removing the yarn waste and miscellanea gathering in the vicinity of so called weft yarn grasping means during the weaving operation of the loom.

In a fluid jet loom, it is usually observed that the stamping operation of the weft yarn grasping means comprising, for example, a stationary disc and a movable disc by which discs a weft yarn is intermittently grasped causes a production of fair amounts of yarn waste or miscellanea. Some of these contaminants are deposited on the contacting surfaces of the stationary and movable discs of the grasping means thus causing a poor function of the grasping means. More specifically, the normal stamping movements of the movable disc to the stationary disc can not be achieved, thus causing the weft yarn to be abnormally pulled back toward the weft yarn strage tube positioned upstream of the grasping means. In addition, the waste yarn deposited on the surface of the weft yarn moving toward the yarn shooting nozzle will cause a blockage of the yarn threading bore formed in the nozzle.

One of the methods to remove such yarn waste and/or miscellanea is to blow off them by using an air blower. However in this case, such contaminants thus blown off are scattered in the air and finally lie on other parts of the loom with a result that the normal functions of the other parts will not be achieved.

SUMMARY OF THE INVENTION

Therefore, the present invention is proposed to provide a fluid jet loom having a yarn waste removing apparatus.

It is an object of the present invention to provide an improved yarn waste removing apparatus which is constructed to remove yarn waste and/or miscellanea gathering in the vicinity of the weft yarn grasping means during the weaving operation of the jet loom.

It is another object of the present invention to provide an improved yarn waste removing apparatus which is constructed in relatively simple and economical manner.

It is a further object of the present invention to provide a fluid jet loom, comprising: grasping means operable to secure a weft yarn passing therethrough; shooting means for shooting the weft yarn into a shed formed in warp yarns to weave fabrics; and a casing disposed about the grasping means, in which casing yarn waste is collectable, the shooting means inducting a partial vacuum in the casing during the operation thereof to induct a flow of air therethrough, the flow of air scavenging the yarn waste collected in the casing to shoot same through the shed into the open air.

BRIEF DESCRIPTION OF THE DRAWINGS

Other objects and advantages of the present invention will become more apparent from the following detailed description when taken in conjunction with the accompanied drawings, in which.

DESCRIPTION OF THE PREFERRED EMBODIMENTS

Figure 1:
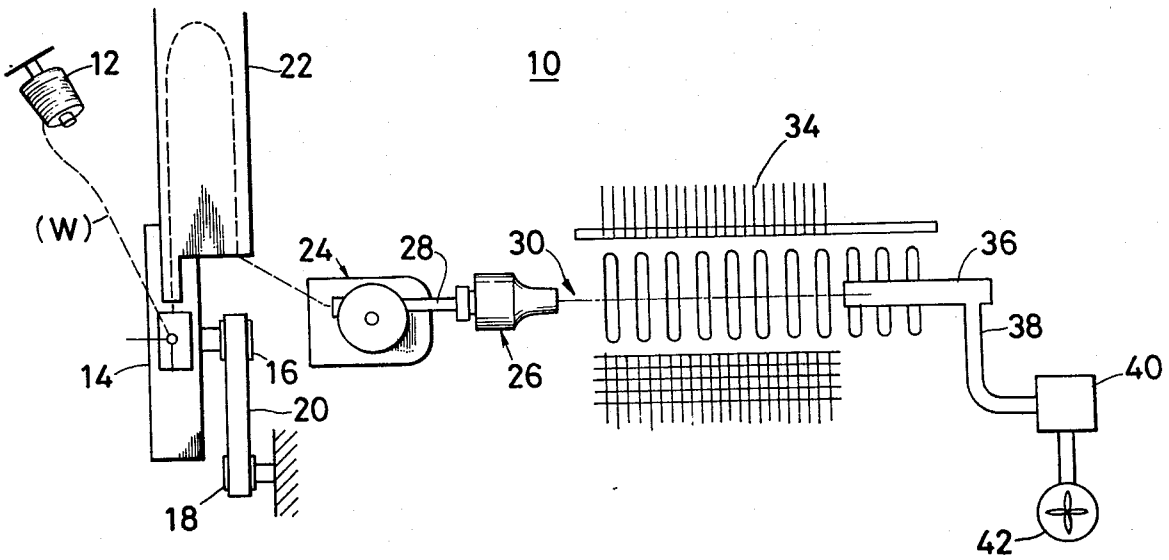
FIG. 1 is a diagrammatical illustration of a fluid jet loom in which the present invention is embodied.

Referring to the drawings, particularly to FIG. 1, there is illustrated a system of a fluid jet loom 10 to which the present invention is applied. A weft yarn (W) is progressibely unwound from a bobbin 12 which is rotatably mounted on a stationary portion (no numeral) and the weft yarn (W) is reached to a measuring device 14 by which a predetermined length of the weft yarn (W) is withdrawn for each picking action. The measuring device 14 in this illustration comprises a drawing-out roller (no numeral) continuously rotated by a motor (not shown) through pulleys 16 and 18 and a connecting belt 20.

The weft yarn (W) coming from the measuring device 14 is then detained within a tubular detaining chamber 22, and passed through weft yarn grasping means 24 to a weft yarn shooting means 26. The detailed description on the constructions of the weft yarn grasping means 24 and the weft yarn shooting means 26 will be given hereinafter since a yarn waste removing apparatus embodying the present invention is accompanied with these means 24 and 26 causing the explanation of the constructions thereof to be complicated. A tube 28 provides a fluid connection between the grasping means 24 and the shooting means 26 in a manner as described hereinlater.

The weft yarn (W) shot from the shooting means 26 is passed through a shed 30 formed by healds (no numeral) which transversely cross the group of warp yarns 34. Although not shown in this drawing, so called weft yarn cutting means for cutting the weft yarn (W) for each picking action is arranged in the vicinity of each side of the group of the warp yarns 34 in a conventional manner.

The extending end of the weft yarn (W) passed through the shed 30 is drawn into a suction tube 36 which is fluidly connected through a connecting tube 38, and a filter 40 to a suction pump 42. The suction pump 42 is arranged to suck or draw the air in the tube 36 toward the filter 40 for not only causing the extending end of the weft yarn (W) to be enforcedly drawn into the tube 36 to achieve preferable shed-passing of the weft yarn but also enforcedly separating at the filter 40 from the ejected air the later-mentioned yarn waste and other miscellanea. The construction of the weft yarn grasping means 24 and the weft yarn shooting means 26 with which the yarn waste removing apparatus is accompanied will be apparent from the following description.

Figure 2:
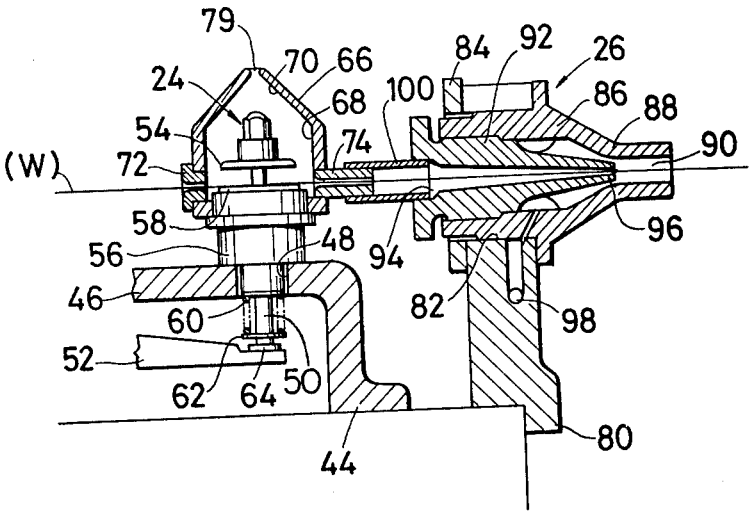
FIG. 2 is a vertical cross sectional view of weft yarn grasping means and weft yarn shooting means which are equipped with a yarn waste removing apparatus embodying the present invention.
Figure 3:
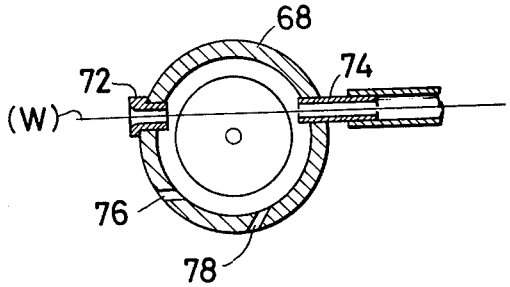
FIG. 3 is a transverse cross sectional view of a part, of the yarn waste removing apparatus, fixed to the weft yarn grasping means.

FIG. 2 shows the detailed constructions of the weft yarn grasping means 24 and the weft yarn shooting means 26 to which a main part of the yarn waste removing apparatus is connected. In this drawing, the weft yarn grasping means 24 is shown as comprising a stand member 44 mounted on a stationary portion of the loom 10 and having a horizontal flat portion 46. The horizontal flat portion 46 is formed with a through hole 48 through which an elongate rod 50 supported at its lower end by a vertically reciprocating lever 52 is passed with its other end equipped with a first or movable disc 54. Mounted on the horizontal flat portion 46 to surround the elongate rod 50 is a cylindrical support member 56 which is equipped at its upper end with a second or stationary disc 58. A coil spring 60 is disposed between the lower surface of the horizontal flat portion 46 and a spring seat 62 fixed to the elongate rod 50 so as to urge the elongate rod 50 downward. The reciprocating lever 52 is provided at its leading end with a seat portion 64 to which the lower end of the elongate rod 50 is engageable. It should be noted that the weft yarn grasping means 24 is so constructed that when the reciprocating lever 52 is shifted downward, the movable disc 54 is brought into contact with the stationary disc 58 with the downward movement of the elongate rod 50 under the action of the spring, and when the lever 52 is shifted upward against the force of the spring 60, the movable disc 54 is separated from the stationary disc 58 with the upward movement of the elongate rod 50. With this, the grasping action made by the movable and stationary discs 54 and 58 to the weft yarn (W) located between the discs 54 and 58 takes place intermittently in accordance with the downward shifting of the reciprocating lever 52. Usually, the reciprocating operation of the lever 52 is synchronous to the picking action of the loom 10, so that the grasping action of the grasping means 24 is synchronous to the picking action of the loom 10. Now, according to the present invention, the following procedure is further required to the weft yarn grasping means 24 to construct the subject yarn waste removing apparatus.

Figure 4:
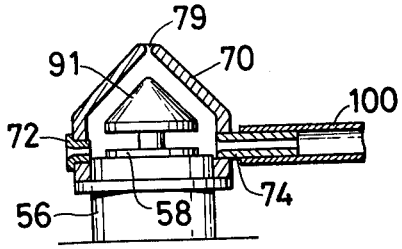
FIG. 4 is a vertical cross sectional view of the part enclosing a weft yarn grasping means which is modified.

A casing 66 is fixed to the grasping means 24 to substantially enclose the upper portion, more specifically, the portion including the movable and stationary discs 54 and 58, of the grasping means 24. Preferably, the casing 66 is made of some transparent material, such as glass and plastics, so that such discs 54 and 58 can be seen from the outside of the casing 66. As shown, the casing 66 comprises a generally cylindrical section 68 encircling the movable and stationary discs 54 and 58 and a generally conical section 70 positioned atop of the cylindrical section 68 to define an enclosed space in the casing 66. A yarn inlet member 72 and a yarn outlet member 74 which are respectively formed therein with through holes are fixed to generally opposite cylindrical sides of the cylindrical section 68, respectively. Preferably, these inlet and outlet members 72 and 74 are arranged in such a manner that an imaginary straight line passing through the holes of the members 72 and 74 lies on the contacting surface of the stationary disc 58, as shown. The generally cylindrical section 68 is further formed with at least one through hole, here shown as having two holes 76 and 78, at positions generally same in height as the yarn inlet and outlet members 72 and 74. The through hole 76, (or 78) is formed to extend toward the inlet opening of the yarn outlet member 74 by the reason which will be described hereinlater. Furthermore, the generally conical section 70 is formed at its apex with a through hole 78. If desired, as seen from FIG. 4, the movable disc 54 may be provided at the upper surface thereof with a conical head member 91 for defining between the inner surface of the conical section 70 of the casing and the outer surface of the conical head member 91 a generally conical clearance. Preferably, the conical head member 91 is constructed similar to the conical section 70 so that the conical clearance has throughout thereof a uniform thickness.

The weft yarn shooting means 26 is shown as comprising a stand member 80 mounted on a stationary portion of the loom 10 and having a nozzle mounting hole 82 at its upper portion. Tightly disposed in the nozzle mounting hole 82 by the assistance of a retaining ring 84 is a cylindrical nozzle casing 86 which has at its one end a coned portion 88 defining a limited bore 90. Screwed into the nozzle casing 86 is a nozzle proper 92 which has therein an axially extending yarn threading bore 94. The nozzle proper 92 has a coned end 96 which is spaced apart from the inner surface of the bore 90 of the nozzle casing 86. Although not shown, the bore 90 is fluidly comminicates with a compressed air supplier (not shown) through a passage 98 and a valve (not shown).

With the construction of the weft yarn shooting means 26, the yarn threading bore 94 of the nozzle proper 92 will be subjected to a vacuum condition when the compressed air from the air supplier passes through the bore 90 in response to the opening action of the valve.

According to the present invention, the following procedure is further required, that is, the threading bore 94 of the nozzle proper 92 and the hole of the yarn outlet member 74 are connected to each other by a tube 100.

With this construction, the yarn waste removing apparatus will operate as follows.

During the operation of the loom 10, the cyclical compressed air ejection from the bore 90 induces a high velocity air flow passing over and around the coned end 96 of the nozzle proper 92. The passage of the high velocity air flow creates low pressure zone within the yarn threading bore 94. As a result, a flow of air is induced through the holes 76, 78 and 79, the chamber of the casing 66 into the yarn threading bore 94, and finally, the flow of air is ejected from the nozzle proper 92. The flow of air from the chamber is carried into the before-mentioned tube 36 of the filtering means after passing through the shed 30 in the warp yarns 34 by the air flow from the compressed air supplier. Now, it should be noted that the flow of air through the chamber of the casing 66 scavenges any yarns waste and other miscellanea collected in the chamber by the stamping action of the weft yarn grasping means 24, and the air flow thus containing such contaminants is then introduced into the tube 36 and finally reaches to the filter 40 to separate such contaminants from the air.

The provision of the through holes 76 and 78 in the cylindrical section 68 of the casing 66 in the before-described manner will improve the scavenging effect of the air flow in the chamber of the casing 66 since the air from such through holes 76 and 78 is tangentially dashed against the inner surface of the cylindrical section 68 to strip off the yarn waste having been deposited on such surface. The provision of the conical head member 91 on the movable disc 54 is made in generally same reason as described hereinabove.

Now, it should be appreciated that with this construction of the waste yarn removing means, the weft yarn setting up procedure of the loom 10 is remarkably facilitated. For example, the weft yarn insertion to the nozzle proper 92 will be readily made only by bringing an end portion of the weft yarn (W) close to the inlet of the yarn inlet member 72 under a state in which the compressed air flow from the compressed air supplier is present within the bore 90.

With this construction of the yarn waste removing apparatus, the following merits and advantages are obtained.

(1) Since the yarn waste and other miscellanea gathering in the casing 66 are effectively removed, the unwanted deposition of the yarn waste on the contacting surfaces of the movable and stationary discs 54 and 58 is excluded. Thus, the normal function of the grasping means is maintained.

(2) Since the air flow induction causing the transportion of the yarn waste in the casing 66 is created by the compressed air supplier which is originally set in the loom 10, the yarn waste removing apparatus is economically produced.

(3) Since the yarn waste and other miscellanea produced are finally deposited on the filter without being scattered in the open air, the surrounding air is not contaminated.

What is claimed is:

1. A fluid jet loom, comprising: grasping means operable to secure a weft yarn passing therethrough;

shooting means for shooting said weft yarn into a shed formed by warp yarns to weave fabrics, said shooting means including a nozzle with a bore fluidly communicable in use with a compressed air supply for producing for each picking action a jet of air inducing a partial vacuum in said bore of the nozzle to cause said weft yarn to be passed through and be ejected from said nozzle; a casing disposed about said grasping means, in which casing yarn waste is collectable, said casing being provided at its generally opposite sides, respectively, with a weft yarn inlet opening and a weft yarn outlet opening, a tube fluidly connecting said outlet opening to said nozzle, whereby when said shooting means operates to cause said weft yarn to be ejected from said nozzle, a flow of air passing through the casing and said tube toward said nozzle is produced thereby scavenging any yarn waste and miscellanea collected in said casing to shoot same through said shed into the open air.

2. A fluid jet loom as claimed in claim 1, in which said tube is disposed for said weft yarn to pass therethrough.

3. A fluid jet loom as claimed in claim 1, in which said casing is further provided with at least one through hole.

4. A fluid jet loom, comprising; a weft yarn supplier; weft yarn measuring means for preparing for each picking action a predetermined length of the weft yarn coming from said weft yarn supplier; weft yarn grasping means including a stationary member and a movable member contactable with each other in response to the picking action to intermittently grasp a portion of the weft yarn coming from said weft yarn measuring means to pass therethrough; shooting means receptive of the weft yarn from said yarn grasping means for shooting said weft yarn into a shed formed by warp yarns to weave fabrics, said shooting means including a nozzle with a threading bore fluidly communicable in use with a compressed air supply for producing for each picking action a jet of air inducing a partial vacuum in said threading bore to cause said weft yarn from said grasping means to be passed through and ejected from said nozzle; a casing for substantially enclosing said weft yarn grasping means and having weft yarn inlet and outlet openings through which said weft yarn coming from said measuring means passes, and the interior of said casing being fluidly connected to the threading bore of said nozzle.

5. A fluid jet loom as claimed in claim 4, including a tube defining a fluid connection between the interior of said casing and the threading bore of said nozzle.

6. A fluid jet loom as claimed in claim 5, in which said tube is disposed for said weft yarn coming from said grasping means to pass through said tube.

7. A fluid jet loom as claimed in claim 4, further comprising filtering means for filtering the air ejected from said nozzle.

8. A fluid jet loom as claimed in claim 7, in which said filtering means comprises: a collecting tube positioned opposite to said nozzle at an opposite side of said shed with an open end thereof facing toward an ejecting opening of said nozzle; a filter connected to the other open end of said collecting tube; and a pump for forcing the air in said collecting tube to be introduced into said filter.

9. A fluid jet loom as claimed in claim 4, in which said casing comprises a generally cylindrical section encircling said stationary and movable members and a generally conical section positioned atop of said cylindrical section to define an enclosed space.

10. A fluid jet loom as claimed in claim 9, in which said generally cylindrical section has at least one auxiliary through hole extending toward said weft yarn outlet opening of said casing.

11. A fluid jet loom as claimed in claim 10, in which said generally conical section is provided at its apex with a through hole.

12. A fluid jet loom as claimed in claim 11, further comprising a conical head member mounted on said movable member of said grasping means to define between the inner surface of said generally conical section of said casing and the outer surface of said conical head member a generally conical space.

13. A fluid jet loom as claimed in claim 10, in which said auxiliary through hole is arranged to extend tangentially to the inner cylindrical surface of said generally cylindrical section.

* * * * *